US008827509B2

(12) United States Patent
Huang

(10) Patent No.: US 8,827,509 B2
(45) Date of Patent: Sep. 9, 2014

(54) LED LAMP BULB WITH A RETAINER RIM

(71) Applicant: Tsung-Hsien Huang, I-Lan Hsien (TW)

(72) Inventor: Tsung-Hsien Huang, I-Lan Hsien (TW)

( * ) Notice: Subject to any disclaimer, the term of this patent is extended or adjusted under 35 U.S.C. 154(b) by 153 days.

(21) Appl. No.: 13/724,778

(22) Filed: Dec. 21, 2012

(65) Prior Publication Data

US 2014/0043816 A1 Feb. 13, 2014

(30) Foreign Application Priority Data

Aug. 13, 2012 (CN) ..... 2012-1-0285831

(51) Int. Cl.

| | |
|---|---|
| ***F21V 29/00*** | (2006.01) |
| ***F21V 17/16*** | (2006.01) |
| ***F21V 17/10*** | (2006.01) |
| ***F21K 99/00*** | (2010.01) |
| *F21V 3/02* | (2006.01) |
| *F21Y 101/02* | (2006.01) |

(52) U.S. Cl.

CPC ..... *F21V 17/10* (2013.01); *F21V 29/2206* (2013.01); *F21V 3/02* (2013.01); *F21V 29/2231* (2013.01); *F21V 17/164* (2013.01); *F21K 9/135* (2013.01); *F21Y 2101/02* (2013.01)

USPC ..... 362/373; 362/294

(58) Field of Classification Search

USPC ..... 362/249.02, 373, 294, 363, 311.02

See application file for complete search history.

(56) References Cited

U.S. PATENT DOCUMENTS

| | | | | |
|---|---|---|---|---|
| 2008/0037255 | A1* | 2/2008 | Wang | 362/294 |
| 2009/0086492 | A1* | 4/2009 | Meyer | 362/294 |

* cited by examiner

*Primary Examiner* — Julie Bannan

(74) *Attorney, Agent, or Firm* — Pai Patent & Trademark Law Fim; Chao-Chang David Pai

(57) ABSTRACT

An LED lamp bulb includes a heat sink carrying LEDs, a radiation fin set including multiple radiation fins radially arranged around the heat sink, an insulative lamp bulb base affixed to the bottom side of the radiation fin set, a light-transmission bulb shell having retaining lugs equiangularly spaced around the bottom open side thereof, and a retainer rim set between the radiation fin set and the light-transmission bulb shell and having protruding strips equiangularly spaced around an inner perimeter of a front wall thereof and respectively plugged into the gaps between each two adjacent ones of the radiation fins and retaining notches equiangularly spaced around an outer perimeter of a back wall thereof and respectively forced into engagement with respective retaining lugs of the light transmission bulb shell.

5 Claims, 5 Drawing Sheets

LED LAMP BULB WITH A RETAINER RIM

BACKGROUND OF THE INVENTION (a) Field of the Invention

The present invention relates to LED lamp technology and more particularly to an LED lamp bulb, which comprises a heat sink, a radiation fin set, an insulative lamp bulb base, a light-transmission bulb shell, and a retainer rim securing the radiation fin set and the light-transmission bulb shell to prevent relative rotation therebetween.

(b) Description of the Prior Art

A conventional LED lamp bulb comprises a heat sink, a radiation fin set, an insulative lamp bulb base, LEDs or a substrate carrying multiple series of LEDs, and a light-transmission bulb shell. The radiation fin set is bonded to the heat sink, having its bottom side affixed to the insulative lamp bulb base. The insulative lamp bulb base is an externally threaded hollow member provided with a metal conducting ring contact. Waste heat produced during operation of the LEDs is transferred to the heat sink and the radiation fin set for dissipation into the outside open air.

The aforesaid radiation fin set comprises a plurality of radiation fins arranged in a radial configuration. In order to prevent the sharp top edges of the radiation fins from injuring people touching them, a ring cap may be used to cover the sharp top edges of the radiation fins. The ring cap is simply capped on the sharp top edges of the radiation fins. It may be forced to rotate relative to the radiation fin set or to fall out of the radiation fin set accidentally by an external force. Further, the light-transmission bulb shell is bonded to the ring cap with an adhesive. However, the adhesive deteriorates after a long use, losing its adhesion power. When this condition occurs, the light-transmission bulb shell will fall from the ring cap. Therefore, this light-transmission bulb shell mounting method is not a satisfactory method.

Further, the light-transmission bulb shell can be made to have a flat profile. Alternatively, the light-transmission bulb shell can have a semi-spherical shape, simulating an incandescent lamp bulb. Conventional LED lamp bulbs are seen in Taiwan Utility Model Numbers M389826; M419035; M353292; M400660; M413817; M422646; M421458; M381724.

SUMMARY OF THE INVENTION

The present invention has been accomplished under the circumstances in view. It is the main object of the present invention to provide an LED lamp bulb, which eliminates the defects of the aforesaid prior art LED lamp bulb designs. According to one aspect of the present invention, the LED lamp bulb comprises a heat sink, a radiation fin set, an insulative lamp bulb base, a light-transmission bulb shell, and a retainer rim. The retainer rim is set between the radiation fin set and the light-transmission bulb shell. The retainer rim is shaped like an annular frame, comprising a plurality of protruding strips equiangularly spaced around an inner perimeter of a front wall thereof and respectively plugged into the gaps between each two adjacent ones of the radiation fins of the radiation fin set to prevent rotation relative to the radiation fin set, and a plurality of retaining notches equiangularly spaced around an outer perimeter of a back wall thereof and respectively forced into engagement with respective retaining lugs of the light transmission bulb shell.

According to another aspect of the present invention, each radiation fin comprises a mounting groove located on an outer side near a top side thereof; the retainer rim further comprises a hooked flange extending around an outer perimeter of the front wall and forced into engagement with the mounting grooves of the radiation fins. Thus, the retaining rim secures the radiation fin set and the light transmission bulb shell securely in position.

DETAILED DESCRIPTION OF THE PREFERRED EMBODIMENTS

Figure 1:
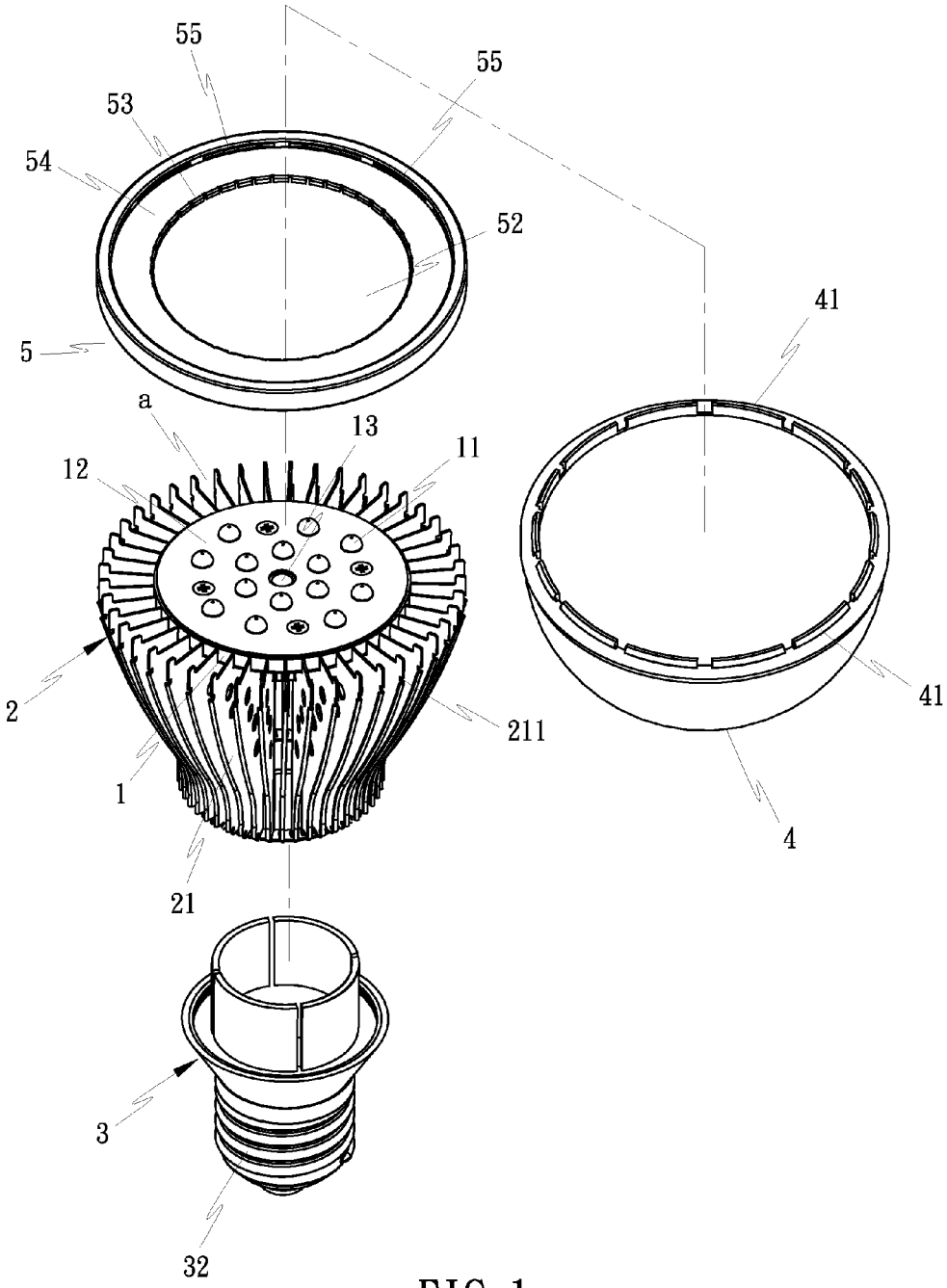
FIG. 1 is an exploded view of an LED lamp bulb in accordance with the present invention.
Figure 2:
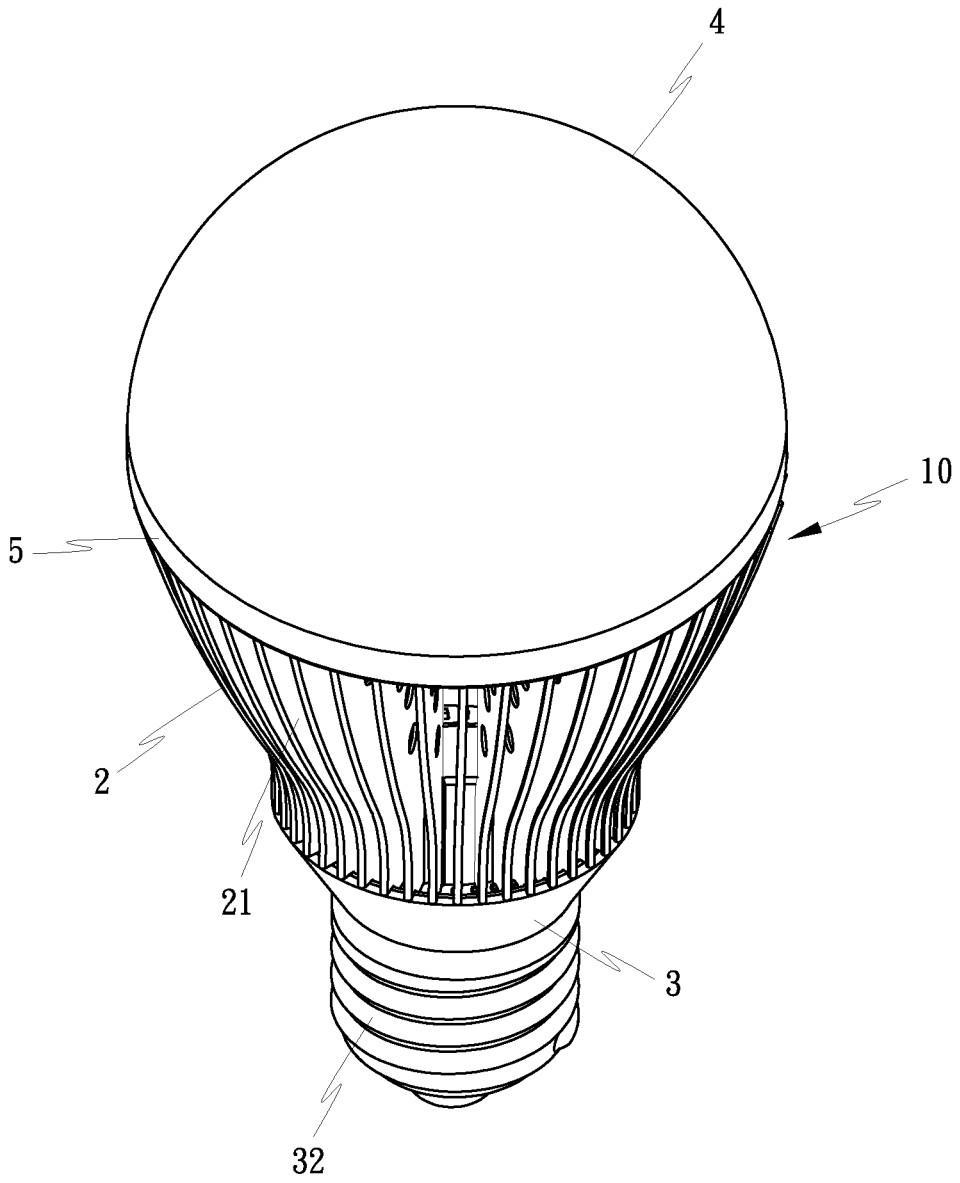
FIG. 2 is a perspective view of the LED lamp bulb in accordance with the present invention.
Figure 3:
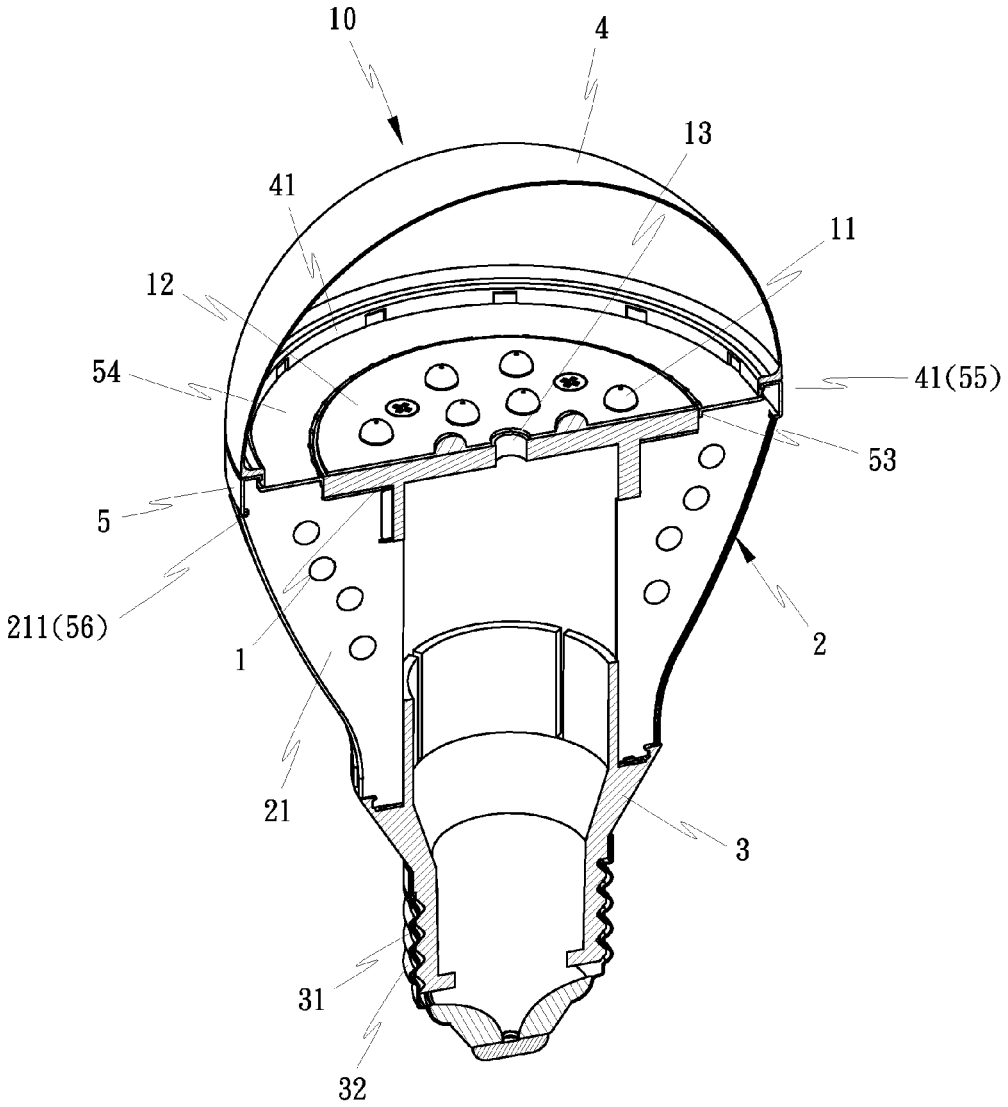
FIG. 3 is a sectional view of the LED lamp bulb in accordance with the present invention.

Referring to FIGS. 1-3, an LED lamp bulb 10 in accordance with the present invention is shown. The LED lamp bulb comprises a heat sink 1, a radiation fin set 2, an insulative lamp bulb base 3, a light transmission bulb shell 4, and a retainer rim 5.

The heat sink 1 carries a light-emitting substrate 12 comprising a plurality of LEDs (light-emitting diodes) 11, a plurality of wire holes 13 for the passing of electric wires.

The radiation fin set 2 comprises a plurality of radiation fins 21 radially arranged around heat sink 1 at predetermined intervals. Each radiation fin 21 defines a mounting groove 211 at an outer side near the top thereof.

The insulative lamp bulb base 3 is configured according to the specification for the base of incandescent bulb, having a threaded bottom portion 31 fixedly covered with a metal conducting ring contact 32.

The light transmission bulb shell 4 is a semispherical shell that admits light and comprises a plurality of retaining lugs 41 equiangularly spaced around the bottom open side thereof. The semispherical shape of the light transmission bulb shell 4 is not a limitation. The light transmission bulb shell 4 can also be configured to provide a flat profile.

Figure 4:
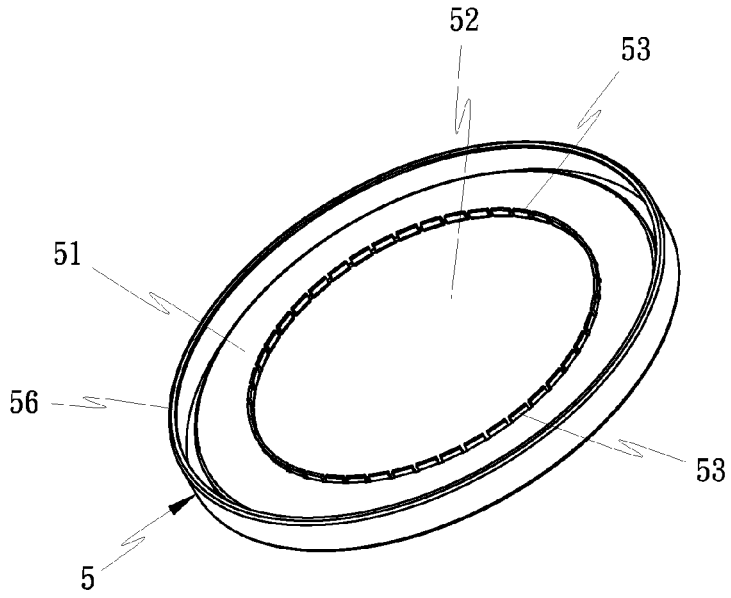
FIG. 4 is an oblique view of the retainer ring of the LED lamp bulb in accordance with the present invention.
Figure 5:
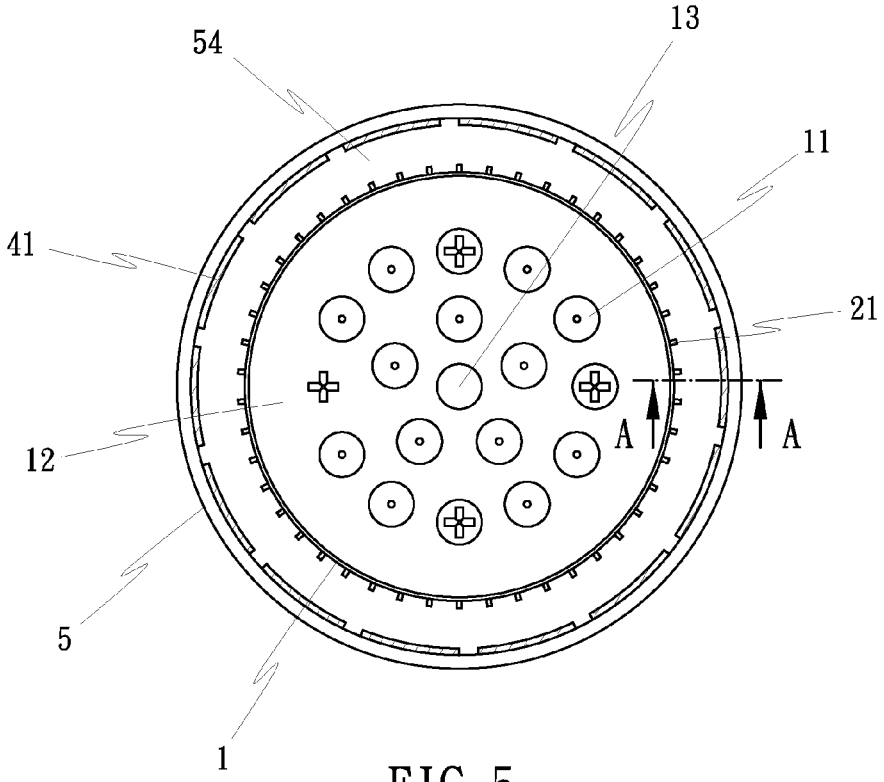
FIG. 5 is a sectional top view of the LED lamp bulb in accordance with the present invention.

The retainer rim 5 is shaped like an annular frame, as shown in FIG. 4, and is joined between the radiation fin set 2 and the light transmission bulb shell 4. The retainer rim 5 comprises opposing front wall 51 and back wall 54, a circular opening 52 defined by the inner perimeter of the front wall 51 and the inner perimeter of the back wall 54, a plurality of protruding strips 53 spaced around the inner perimeter of the front wall 51, a plurality of retaining notches 55 equiangularly spaced around the outer perimeter of the back wall 54 (see FIG. 1), and a hooked flange 56 extending around the outer perimeter of the front wall 51.

The protruding strips 53 of the retainer rim 5 are respectively engaged into the gaps a between each two adjacent ones of the radiation fins 21 of the radiation fin set 2 (see FIG. 1) to prohibit relative rotation between the retainer rim 5 and the radiation fin set 2, and then the retaining notches 55 of the retainer rim 5 are respectively forced into engagement with the retaining lugs 41 of the light transmission bulb shell 4. Thus, the radiation fin set 2, the retainer rim 5 and the light transmission bulb shell 4 are firmly secured together.

After insertion of the protruding strips 53 of the retainer rim 5 into the gaps a between each two adjacent ones of the radiation fins 21 of the radiation fin set 2, the two opposite lateral sides of each protruding strip 53 are respectively abutted against the respective two adjacent radiation fins 21, preventing rotation of the retainer rim 5 relative to the radiation fin set 2.

Further, the hooked flange 56 at the front wall 51 of the retainer rim 5 is adapted for engaging the mounting grooves 211 of the radiation fins 21 of the radiation fin set 2.

Figure 6:
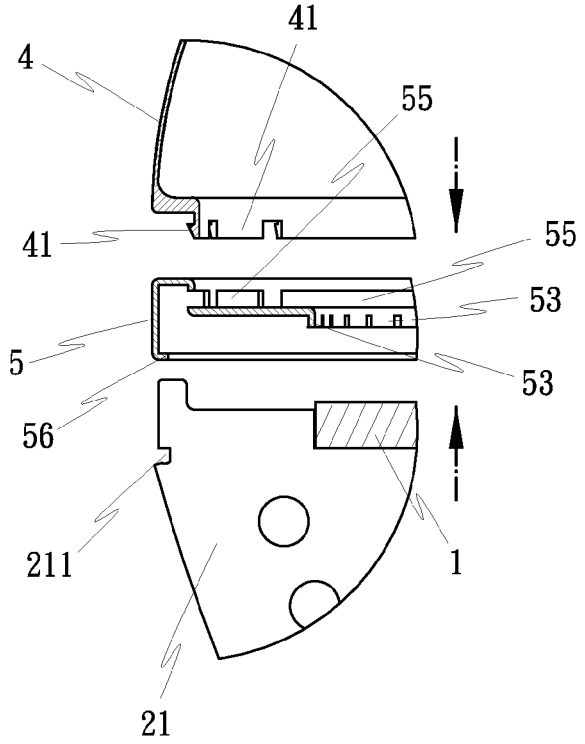
FIG. 6 is a sectional view taken along line A-A of FIG. 5.
Figure 7:
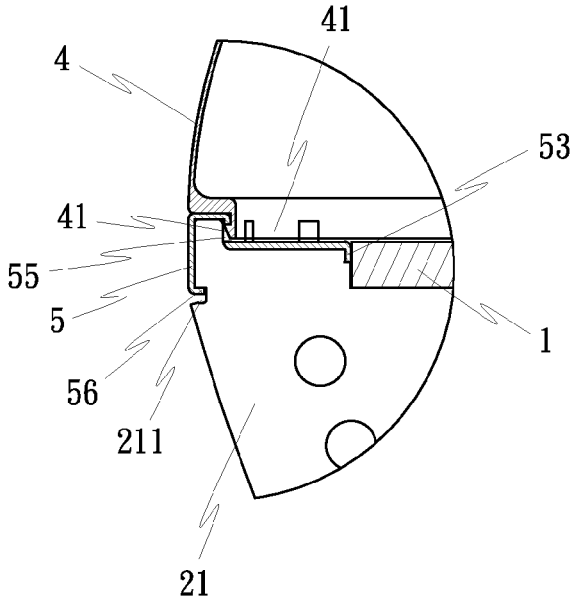
FIG. 7 is a schematic sectional assembly view of a part of the LED lamp bulb in accordance with the present invention.

According to the design of the present invention, the retainer rim 5 is used to secure the radiation fin set 2 at the bottom side and the light-transmission bulb shell 4 at the top side (see FIGS. 6 and 7), preventing relative rotation between the radiation fin set 2 and the light-transmission bulb shell 4. Further, the hooked flange 56 of the retainer rim 5 can be hooked on the radiation fin set 2 to enhance connection stability. Further, the protruding strips 53 of the retainer rim 5 are tightly stopped with the respective inner sides thereof against the heat sink 1 (see FIG. 7) for transferring and dissipating waste heat rapidly.

As stated above, the retainer rim 5 can be positioned on the radiation fin set 2 to secure the light-transmission bulb shell 4. Further, the retainer rim 5 can be an annular metal frame suitable for mass production using metal stamping technology. Alternatively, the retainer rim 5 can be selected from any other suitable material, for example, plastics.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An LED lamp bulb, comprising a heat sink, a radiation fin set, an insulative lamp bulb base, a light-transmission bulb shell and a retainer rim, said heat sink having a light-emitting substrate bonded to a top side thereof, said light-emitting substrate carrying a plurality of light-emitting diodes, said radiation fin set comprising a plurality of radiation fins radially arranged around said heat sink at predetermined intervals, said insulative lamp bulb base being affixed to a bottom side of said radiation fin set, said retainer rim being set between said radiation fin set and said light-transmission bulb shell, wherein:

said light-transmission bulb shell comprises a plurality of retaining lugs equiangularly spaced around a bottom open side thereof;

said retainer rim is an annular frame comprising opposing front wall and back wall, a plurality of protruding strips equiangularly spaced around an inner perimeter of said front wall and respectively plugged into gaps between each two adjacent ones of said radiation fins of said radiation fin set, and a plurality of retaining notches equiangularly spaced around an outer perimeter of a back wall thereof and respectively forced into engagement with the respective retaining lugs of said light transmission bulb shell.

2. The LED lamp bulb as claimed in claim 1, wherein each said radiation fin of said radiation fin set comprises a mounting groove located on an outer side near a top side thereof; said retainer rim comprises a hook flange hooked on the mounting grooves of said radiation fins of said radiation fin set.

3. The LED lamp bulb as claimed in claim 1, wherein said retainer rim is an annular metal frame.

4. The LED lamp bulb as claimed in claim 1, wherein said protruding strips of said retainer rim each have opposing lateral sides thereof respectively abutted against respective adjacent said radiation fins.

5. The LED lamp bulb as claimed in claim 1, wherein said protruding strips of said retainer rim each have an inner side stopped against the periphery of said heat sink.

* * * * *